United States Patent [19]

Akazawa et al.

[11] Patent Number: 4,492,484

[45] Date of Patent: Jan. 8, 1985

[54] IMPROVED RIBBON MASK AND GUIDE FOR WIRE DOT PRINTERS

[75] Inventors: Hiroyuki Akazawa, Shiojiri; Kazue Yoshiie, Okaya, both of Japan

[73] Assignees: Epson Corporation, Tokyo; Okaya Kogyo Kabushiki Kaisha, Nagano; Kabushiki Kaisha Suwa Seikosha, Tokyo, all of Japan

[21] Appl. No.: 407,859

[22] Filed: Aug. 13, 1982

[30] Foreign Application Priority Data

Aug. 21, 1981 [JP] Japan ..... 56/124012[U]

[51] Int. Cl.[3] ..... B41J 35/04; B41J 35/26

[52] U.S. Cl. ..... 400/248; 400/124

[58] Field of Search ..... 400/124, 248

[56] References Cited

U.S. PATENT DOCUMENTS

| | | | |
|---|---|---|---|
| 4,062,436 | 12/1977 | Kondur et al. | 400/124 |
| 4,165,188 | 8/1979 | Rempel | 400/248 X |
| 4,225,250 | 9/1980 | Wagner et al. | 400/124 |
| 4,277,187 | 7/1981 | Rello | 400/248 |
| 4,279,525 | 7/1981 | Johnston | 400/124 X |
| 4,325,645 | 4/1982 | Miyajima et al. | 400/248 X |
| 4,383,775 | 5/1983 | Trammell et al. | 400/248 X |

*Primary Examiner*—Paul T. Sewell

*Attorney, Agent, or Firm*—Blum, Kaplan, Friedman, Silberman & Beran

[57] ABSTRACT

A printing device for use in a wire dot printer having a plurality of printing wires. The printing device includes a frame and a carriage slidably supported on the frame for lateral translation thereacross. A printing head is supported on the carriage and includes a nose member which supports the plurality of printing wires. First and second holding members are disposed on the carriage so that the nose member is intermediate the first and second holding members. A ribbon mask constructed from an elastic material is disposed on the nose member. The ribbon mask is removably held between the first and second holding members and extends across the nose member.

16 Claims, 7 Drawing Figures

FIG. 2
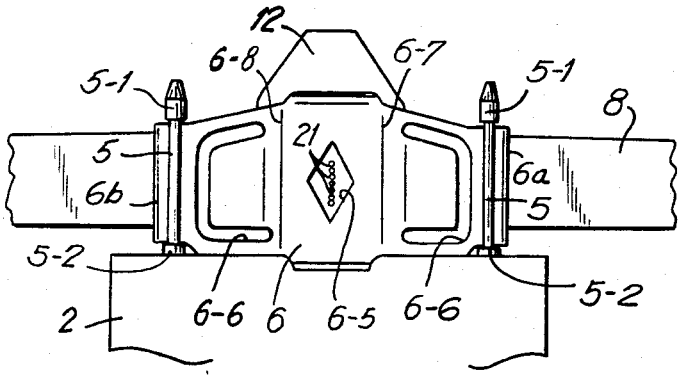
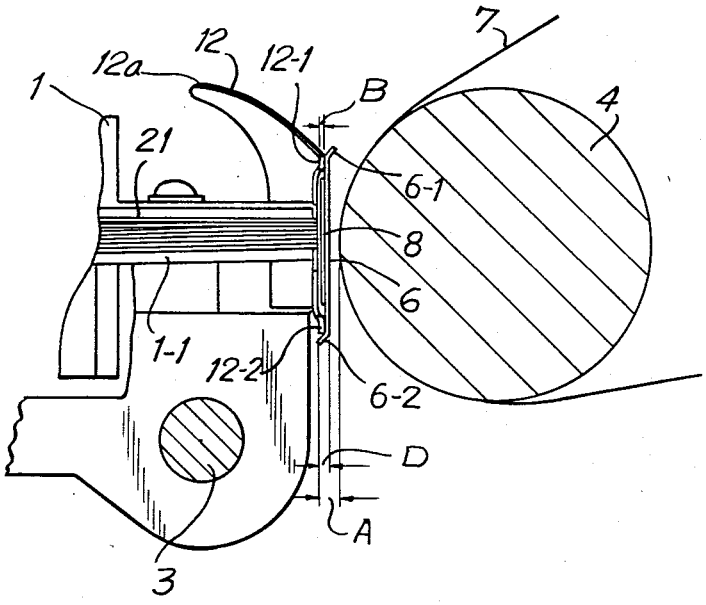
FIG. 3

FIG. 4
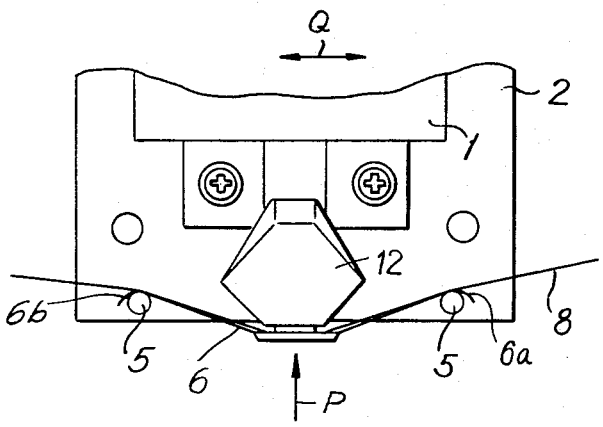
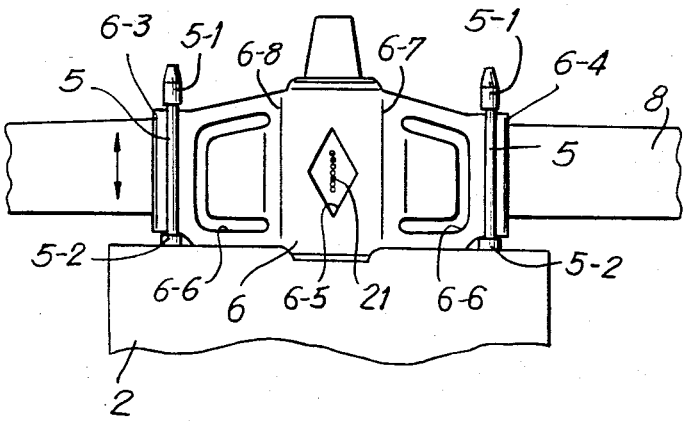
FIG. 5

FIG. 6
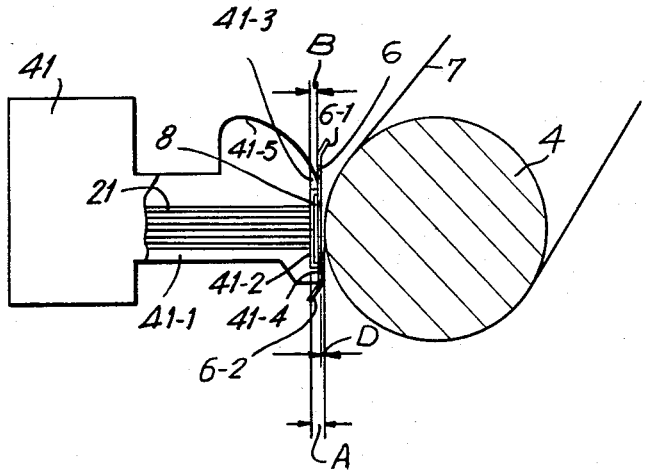
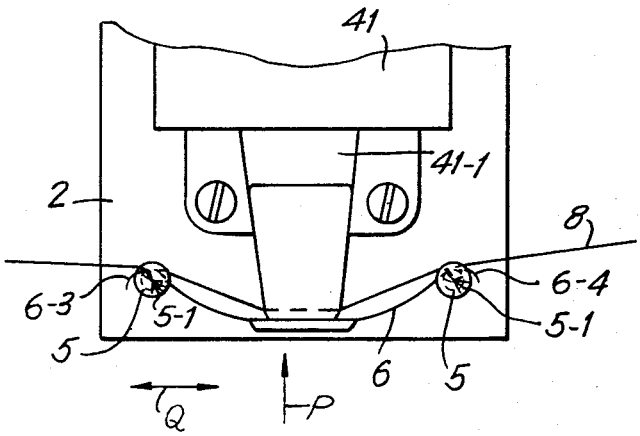
FIG. 7

IMPROVED RIBBON MASK AND GUIDE FOR WIRE DOT PRINTERS

BACKGROUND OF THE INVENTION

The present invention is directed to a serial printer employing a wire dot printing head and, in particular, to a serial printer having a wire dot printing head where a ribbon mask is attached to and held between the end of the printing head and a platen in the printer to separate a printing paper from the printer ink ribbon.

In conventional serial printers using wire dot printing heads, a ribbon mask made of a thin material is set up in the gap defined between the end of the printing head and the platen, hereinafter referred to as "platen gap", in order to separate the printing paper from the printer ink ribbon. Such a structure serves to prevent problems caused by contact between the printing paper and the ink ribbon. However, the platen gap must be determined considering the performance of the printing head such as printing speed, duplicating capacity, durability, noise and the like so as to obtain high printing quality. Such conditions permit the platen gap to be generally between 0.4 and 0.5 mm. Such a gap is so small that precision is required in assembling and adjustment.

In order to gain such an extremely small width for the platen gap, it is usual to utilize a method wherein the platen gap is adjusted with a thickness gauge interposed between the end of the printing head and the platen in assembling. On the other hand, the set position of the ribbon mask in such a small platen gap affects the feed of the printing paper and the transportation of the ink ribbon past the printing head. For example, when the gap between the end of the printing head and the ribbon mask is smaller than the thickness of the ink ribbon, problems will be created such as unsmooth transportation of the ink ribbon or breakage thereof. Unless the gap between the ribbon mask and the platen is at least as large as the thickness of the printing paper, other problems will be created such as failure or difficulty in inserting the printing paper and unsmooth feed of the printing paper.

Accordingly, precision is required in adjusting the position of the ribbon mask in addition to adjusting the platen gap. However, in conventional serial printers, the ribbon mask is secured to the printer carriage or the printer head so that the following disadvantages are produced. First, a ribbon mask placed in the platen gap prevents the precision necessary in adjusting the platen gap, as a result of which the printing head will not accomplish its required performance. Second, ribbon masks may be fixed in several positions according to the assembler's skill, which presents the aforedescribed problems affecting printing paper feed and transportation of the ink ribbon past the printing head. Third, when a printing head or ribbon mask needs to be replaced, the aforementioned adjustments cannot be made by general users who are not skilled in adjusting the various parts and gaps. Accordingly, a printer employing a wire dot printing head which avoids the aforedescribed problems, is desired.

SUMMARY OF THE INVENTION

Generally speaking, in accordance with the present invention, a printing device for use in a wire dot printer having a plurality of printing wires, is provided. The printing device includes a frame and a carriage slidably supported on the frame for lateral translation thereacross. A printing head is supported on the carriage and includes a nose member which holds the plurality of printing wires. First and second holding members are disposed on the carriage so that the nose member is intermediate the first and second holding members. A ribbon mask constructed from an elastic material is disposed on the nose member. The ribbon mask is removably held between the first and second holding members so as to extend across te nose member.

This construction insures that proper paper feed and ink ribbon transport will occur without interference. The platen gap remains unaffected and stable.

Accordingly, it is an object of the present invention to provide an improved serial printer utilizing a wire dot printing head.

Another object of the present invention is to provide an improved ribbon mask for a serial printer.

Yet another object of the present invention is to provide a serial printer having a ribbon mask disposed on the printing head which insures positive paper feed and ink ribbon transportion.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 2 is a front elevational view of the printing head and ribbon mask depicted in FIG. 1, constructed in accordance with a preferred embodiment of the present invention;

FIG. 3 is a side sectional view of the printing head and ribbon mask depicted in FIG. 2;

FIG. 4 is a top plan view of the printing head and ribbon mask depicted in FIG. 2;

FIG. 5 is a front elevational view of a printing head and ribbon mask constructed in accordance with an alternate embodiment of the present invention;

FIG. 6 is sectional side elevational view of the printing head and ribbon mask depicted in FIG. 5; and FIG. 7 is a top plan view of the printing head and ribbon mask depicted in FIG. 5.

DESCRIPTION OF THE PREFERRED EMBODIMENTS

Figure 1:
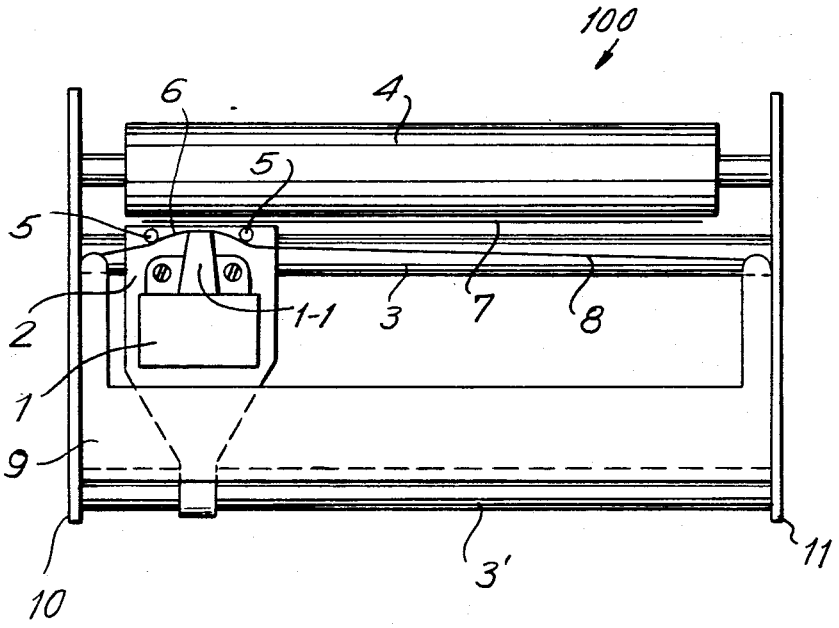
FIG. 1 is a top plan schematic view of a serial printer constructed in accordance with the present invention.

Referring first to FIG. 1, a serial printer, generally indicated at 100, constructed in accordance with a preferred embodiment of the present invention is depicted. Printer 100 includes a carriage 2 supporting a printing head 1 thereon. Carriage 2 driven by the printer drive mechanism to laterally reciprocate printing head 1 across a printing paper 7 disposed in front of a platen 4. Guide shafts 3 and 3' guide carriage 2. A ribbon mask 6 made of a thin elastic material such as a stainless steel sheet is interposed between holding members or pins 5 provided on carriage 2 and a nose portion 1-1 of printing head 1. An ink ribbon 8 is stored in a ribbon cartridge 9 and travels in front of printing head 1. Printer 100 includes side frames 10 and 11 which support guide shafts 3 and 3' and ribbon cartridge 9.

Referring now to FIGS. 2 through 4, a nose guide 12 is attached to the end of nose portion 1-1 of printing head 1. Nose portion 1-1 supports printing wires 21 therein. In the printer standby state, printing wires 21 are aligned on the surface of nose guide 12 opposite to platen 4 with a gap A provided between nose guide 12 and platen 4.

Nose guide 12 has two minute projections 12-1 and 12-2 on upper and lower portions, respectively of its surface opposite to platen 4 in such a manner as to allow ink ribbon 8 to be disposed between projections 12-1 and 12-2. Minute projections 12-1 and 12-2 are of height B which value is determined by adding approximately 0.05 mm to the thickness of ink ribbon 8. Moreover, the upper part 12*a* of nose guide 12 is bent like an arch toward printing head 1 so as to facilitate the insertion of ink ribbon 8 in setting it in. As described above, nose guide 12 functions to facilitate the insertion of ink ribbon 8 and to maintain a gap suitable for stable transportion of ink ribbon 8.

Ribbon mask 6 is installed between the pair of holding members or pins 5 and nose guide 12 and is urged to the direction of arrow P by its own spring elastic into contact with minute projections 12-1 and 12-2. Holding members 5 have step portions 5-1 and 5-2 at the top and bottom ends thereof, respectively, to restrict the vertical movement of ribbon mask 6 as best depicted in FIG. 2. Side ends 6*a* and 6*b* of ribbon mask 6 are hook-shaped as best depicted in FIG. 4 so as to being engagable with holding members 5 whereby ribbon mask 6 is prevented from moving in the direction of arrow Q. Accordingly, ribbon mask 6, once set in position will not be disturbed from the set position unless the operator desires to forceably remove same.

The attachment or removal of ribbon mask 6 is easily performed by only pressing both side ends 6*a* and 6*b* thereof in the direction of arrow P due to the elasticity of ribbon mask 6. As aforenoted, ribbon mask 6 is not fixed on carriage 2 or printing head 1 by screws or the like, so that ribbon mask 6 is readily set up or removed in response to operator requirements. In addition, the platen gap can be adjusted with a thickness gauge interposed in the platen gap having no ribbon mask therein. Therefore, such a minute platen gap is precisely determined. Thus, after fixing printing head 1 on carriage 2, the ribbon mask 6 is easily attached to printing head 1. Accordingly, the above mentioned procedure can be carried out even by general users or operators who are not expertly skilled in such matters.

Ribbon mask 6 has an opening 6-5 through which printing wires 21 pass. Ribbon mask 6 also includes escape slots 6-6 on each side of opening 6-5 to thereby adjust elasticity of ribbon mask 6 and to determine the appropriate pressure or force which are necessary in setting ribbon mask 6. Around opening 6-5, ribbon mask 6 has bent portions 6-1, 6-2, 6-7 and 6-8 formed in manufacture. This improves the stiffness of the contact surface of ribbon mask 6. Additionally, the upper bent portion 6-1 of ribbon mask 6 is bent toward platen 4 to thereby facilitate the insertion of ink ribbon 8 therebehind. Furthermore, the upper bent portions 6-1 of ribbon mask 6 is longer than the lower bent portion 6-2 thereof. Due to this construction, it can readily be determined which is the top and bottom of ribbon mask 6. On the other hand, the lower bent portion 6-2 is bent toward nose guide 12 to thereby prevent ribbon mask 6 from being inadvertently removed.

Ribbon mask 6 as described above, is installed between holding members or pins 5 and nose guide 12 in contact with minute projections 12-1 and 12-2 with the result that the gap B is surely gained between ribbon mask and the surface of the nose guide 12 opposed to the platen 4. Accordingly, ink ribbon 8 makes smooth travel in the lateral direction. On the other hand, the gap D, which is the path for printing paper 7 is defined as follows, assuming that the thickness of ribbon mask 6 is C:

$$D=A-B-C.$$

Hence, the gap D is automatically determined if the ribbon mask 6 is installed. For example, in the case where A=0.5 mm and ribbon mask 6 is made of a 0.1 mm thick stainless steel sheet, as an ink ribbon usually has approximately 0.1 mm thickness, the gap B is determined as follows:

$$B=0.1+0.5 \text{ mm},$$

and the gap D is as follows:

$$D=0.5-0.15-0.1=0.25 \text{ mm}.$$

On account of the thickness gap D as determined by the above equations, even if several sheets of paper are inserted in gap D, they are smoothly fed without resistance.

As described above, it is readily determined that the size of the platen gap affects the basic performance of the printing head by positively separating printing paper 7 from ink ribbon 8 and to hold ribbon mask 6 with the gap necessary to stable feeding of paper 7 and ink ribbon 8. Moreover, ribbon mask 6 is easily inserted or removed from the set position even by general operators without any adjustment.

Referring now to FIGS. 5 through 7, an alternate embodiment of the present invention will be described. In the embodiment described above with reference to FIGS. 1 through 4, nose guide 12 is a separate element which is attachable to the end of nose portion 1-1 of printing head 1. In contrast thereto, in the present embodiment under discussion, the nose guide is unitarily formed with the nose portion. Thus, a nose portion 41-1 holding printing wires 21 therein has upper and lower minute projections 41-3 and 41-4 of height B formed directly on its surface 41-2 opposed to platen 4 in order to allow an ink ribbon 8 to be disposed between both projections 41-3 and 41-4. The height B is determined by adding approximately 0.05 mm to the thickness of ink ribbon 8. An upper portion 41-5 of nose portion 41-1 is bent like an arch toward printing head 41 to thereby facilitate the insertion of ink ribbon 8 in setting it in.

Wires 21, in the standby condition, are aligned on the surface 41-2 of nose portion 41-1 opposite to platen 4 with a platen gap A defined between surface 41-2 and platen 4.

Since the construction of ribbon mask 6 and holding members 5 are substantially similar to that described above with reference to FIGS. 2 through 4, a detailed description thereof is unnecessary in view of the detailed description above. Furthermore, the embodiment depicted in FIGS. 5 through 7 is similar to the embodiments depicted in FIGS. 2 through 4 concerning the relation between platen gap A, the height B of the minute projections and the gap D which is the path for printing paper 7. The side ends of ribbon mask 6 may include hook portions 6-3 and 6-4 bent at least 90° outward in the portion engaged with holding members 5 as best depicted in FIG. 7.

Holding members 5 may also be unitarily formed with carriage 2 or formed directly on the printing head. In addition, various changes and modifications in the shape of holding members 5 may be made other than the present embodiment in which holding members 5 are pin-shaped members provided with step portions. Regardless of the construction of holding members 5, it is necessary that the ribbon mask is attachable by utilizing the elasticity thereof.

As described above, according to the present invention, after adjusting the gap between the printing head and platen and securing the printing head to the carriage, the ribbon mask is easily installed or removed. This facilitates high precision in the gap adjustment and the facility of assemblying the printer is greatly increased. In addition, due to the minute projections on the nose side, the ribbon mask is held in the predetermined position with no adjustment and it is possible to maintain a gap through which the ink ribbon and printing paper are fed without obstruction. The ribbon mask is readily installed or removed, with the result that maintenance such as the replacement of the ribbon mask of the printing head can also be performed by general users with minimal training or experience.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which as a matter of language, might be said to fall therebetween.

What is claimed is:

1. A printing device for use in a wire dot printer having a plurality of printing wires, comprising a frame, a carriage means slidably supported on said frame for lateral translation thereacross, printing head means supported on said carriage means having a nose member for holding said plurality of wires, first and second holding means disposed on said carriage means so that said nose member is intermediate said first and second holding means, a ribbon mask constructed from an elastic material and disposed on said nose member, said ribbon mask being removably held between said first and second holding means so as to extend across said nose member, said printing head means including a nose guide coupled to said nose member, and an ink ribbon having upper and lower edges disposed intermediate said nose guide and said ribbon mask, said nose guide having first and second projections disposed proximate said upper and lower edges of said ink ribbon respectively to limit longitudinal movement of said ink ribbon therebetween, said first and second holding means being pin-shaped and being disposed on opposite sides of said nose member, said first and second holding means each including spaced step portions.

2. The printing device as claimed in claim 1, wherein said ribbon mask has an opening through which said printing wires can extend.

3. The printing device as claimed in claim 1, wherein said ribbon mask includes first and second ends, said first and second ends being captured between the respective step portions of said first and second holding means, respectively.

4. A printing device for use in a wire dot printer having a plurality of printing wires, comprising a frame, a carriage means slidably supported on said frame for lateral translation thereacross, printing head means supported on said carriage means having a nose member for holding said plurality of wires, first and second holding means disposed on said carriage means so that said nose member is intermediate said first and second holding means, a ribbon mask constructed from an elastic material and disposed on said nose member, said ribbon mask being removably held between said first and second holding means so as to extend across said nose member, said printing head means including a nose guide coupled to said nose member, and an ink ribbon having upper and lower edges disposed intermediate said nose guide and said ribbon mask, said nose guide having first and second projections disposed proximate said upper and lower edges of said ink ribbon respectively to limit longitudinal movement of said ink ribbon therebetween, said ribbon mask including an opening through which said printing wires can extend, said ribbon mask including at least one slot for setting the tension in said ribbon mask when disposed between said first and second holding means.

5. The printing device as claimed in claim 4, wherein said first and second holding means are pin-shaped and are disposed on opposite sides of said nose member.

6. The printing device as claimed in claim 1 or 4, wherein said wire dot printer includes a platen disposed on said frame, said nose member keeping said plurality of printing wires aligned opposite said platen.

7. The printing device as claimed in claim 1 or 4, wherein said projections are slightly higher than the thickness of said ink ribbon.

8. The printing device as claimed in claim 7, wherein said nose guide includes an upper portion, said upper portion arching away from said ribbon mask.

9. The printing device as claimed in claim 2, wherein said ribbon mask is urged against said first and second projections when held between said first and second holding means due to the elasticity of said ribbon mask.

10. The printing device as claimed in claim 7, wherein said ribbon mask is urged against said first and second projections when held between said first and second holding means due to the elasticity of said ribbon mask.

11. The printing device as claimed in claim 6, wherein said nose member has an upper portion, said upper portion being arched away from said ribbon mask and toward said printing head means.

12. The printing device as claimed in claim 11, wherein said ribbon mask includes first and second hook-shaped ends, said first and second hook shaped ends being held by said first and second holding means, respectively.

13. The printing device as claimed in claim 6, wherein said ribbon mask includes upper and lower portions, said upper portion of said ribbon mask being bent towards platen.

14. The printing device as claimed in claim 13, wherein said lower portion of said ribbon mask is bent towards said printing head means.

15. The printing device as claimed in claims 1 or 4, wherein said ribbon mask includes first and second hook-shaped ends, said first and second hook shaped ends being held by said first and second holding means, respectively.

16. The printing device as claimed in claims 1 or 4, wherein said ribbon mask is constructed from a stainless steel sheet.

* * * * *